US007987751B2

(12) United States Patent
Shiokawa et al.

(10) Patent No.: US 7,987,751 B2
(45) Date of Patent: Aug. 2, 2011

(54) SHEET TRIMMING APPARATUS AND IMAGE FORMING SYSTEM

(75) Inventors: Tsuyoshi Shiokawa, Hachioji (JP); Hiroyuki Wakabayashi, Hachioji (JP); Masaaki Uchiyama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 514 days.

(21) Appl. No.: 11/706,203

(22) Filed: Feb. 15, 2007

(65) Prior Publication Data

US 2007/0274739 A1 Nov. 29, 2007

(30) Foreign Application Priority Data

May 23, 2006 (JP) ..... 2006-142541

(51) Int. Cl.
*B26D 7/18* (2006.01)

(52) U.S. Cl. ..... 83/147; 83/166; 83/167; 222/527; 222/533

(58) Field of Classification Search ..... 83/167, 83/147, 149, 157, 165, 166, 106; 222/527, 222/533

See application file for complete search history.

(56) References Cited

U.S. PATENT DOCUMENTS

| | | | | | |
|---|---|---|---|---|---|
| 2,835,269 | A * | 5/1958 | Seymour | 137/467 |
| 3,090,527 | A * | 5/1963 | Rensch | 222/610 |
| 3,850,349 | A * | 11/1974 | Pirovano | 222/529 |
| 3,880,031 | A * | 4/1975 | Rodermund et al. | 83/81 |
| 4,040,318 | A * | 8/1977 | Makeev et al. | 83/76.8 |
| 4,395,269 | A * | 7/1983 | Schuler | 55/302 |
| 4,407,628 | A * | 10/1983 | Pearson et al. | 414/788.9 |
| 4,445,409 | A * | 5/1984 | Mohr et al. | 83/157 |
| 4,650,128 | A * | 3/1987 | Goldhammer | 241/36 |
| 4,697,486 | A * | 10/1987 | Vulcano | 83/79 |
| 5,062,340 | A * | 11/1991 | Greven | 83/95 |
| 5,179,884 | A * | 1/1993 | Kutschker et al. | 83/156 |
| 5,218,894 | A * | 6/1993 | College et al. | 83/23 |
| 6,435,395 | B1 * | 8/2002 | Miyaguchi et al. | 227/27 |
| 7,395,744 | B2 * | 7/2008 | Connor | 83/106 |
| 7,461,578 | B2 * | 12/2008 | Tamura et al. | 83/147 |
| 2003/0034373 | A1 * | 2/2003 | Yuyama et al. | 225/96.5 |

* cited by examiner

*Primary Examiner* — Kenneth E. Peterson
(74) *Attorney, Agent, or Firm* — Finnegan, Henderson, Farabow, Garrett & Dunner, L.L.P.

(57) ABSTRACT

A sheet trimming apparatus including: a trimming section provided with a trimming cutter blade for trimming a sheet bundle; a paper scrap container for storing paper scraps separated from the sheet bundle by the trimming cutter blade; and a paper scrap guide member, which is provided to create a falling space where the paper scraps are made to fall from the trimming section to the paper scrap container, wherein the paper scrap guide member assumes a first state for expanding a gap in the falling space, and a second state for creating an inclined surface for guiding the paper scraps to fall.

3 Claims, 12 Drawing Sheets

SHEET TRIMMING APPARATUS AND IMAGE FORMING SYSTEM

CROSS REFERENCE TO RELATED APPLICATION

The present application is based on Japanese Patent Application No. 2006-142541 filed with Japan Patent Office on May 23, 2006, the entire content of which is hereby incorporated by reference.

BACKGROUND OF THE INVENTION

1. Field of the Invention

The present invention relates to a sheet trimming apparatus for trimming a sheet bundle and an image forming system provided with this sheet trimming apparatus.

2. Prior Art

A high-speed image forming apparatus such as an electrophotographic image forming apparatus is connected with various types of optional devices. One of such optional devices is a sheet trimming apparatus that forms a plurality of sheets into a bundle which is then trimmed to align the ends of the sheet bundle.

The aforementioned sheet trimming apparatus is used as an optional device attached to the image forming apparatus, and therefore, is required to have a compact configuration.

The sheet trimming apparatus is required to dispose of the paper scrap separated from the sheet bundle by trimming. The compact sheet trimming apparatus uses a method of collecting the falling paper scrap into a paper scrap container.

The Patent Documents 1 and 2 employ a method wherein a paper scrap ejection chute is arranged in the space for a falling paper scrap, which is led into the paper scrap container.

Patent Document 1: Unexamined Japanese Patent Application Publication No. 2003-25759

Patent Document 2: Unexamined Japanese Patent Application Publication No. 2006-26754

As described above, the sheet trimming apparatus attached to the image forming apparatus is required to have a compact configuration. When it has a compact configuration, the space for the falling paper scrap is limited and the paper scrap may be jammed in the falling space. This problem has been left unsolved. In the Patent Documents 1 and 2, the angle of the chute is variable. It is variable in order to set the chute at the position that forms the falling space and at the position that does not form the falling space. The chute located at the position that forms the falling space is fixed.

As shown in FIG. 1, the paper scraps TS of various sheet widths V are produced due to the relationship between the sheet SA prior to trimming and the sheet SB (indicated by dotted lines) subsequent to trimming. What is called the sheet width V here is defined as the length of the paper scrap TS perpendicular to the edge E formed by trimming.

If the gap is reduced in the falling space where the paper scrap falls, the paper scrap may be jammed in the falling gap in some cases. Particularly the paper scrap TS of greater sheet width V tends to be jammed.

In the sheet trimming apparatus disclosed in the Patent Documents 1 and 2, the chute is fixed at a position for leading the falling paper scrap. This arrangement tends to cause the paper scrap to be jammed in the chute.

SUMMARY OF THE INVENTION

A structure reflecting one aspect of the present invention is a sheet trimming apparatus comprising:

a trimming section provided with a trimming cutter blade for trimming a sheet bundle;

a paper scrap container for storing paper scraps separated from the sheet bundle by the trimming cutter blade; and a paper scrap guide member, which is provided to create a falling space where the paper scraps are made to fall from the trimming section to the paper scrap container, wherein the paper scrap guide member assumes a first state for expanding a gap in the falling space, and a second state for creating an inclined surface for guiding the paper scraps to fall.

A structure reflecting another aspect of the present invention is an image forming system comprising:

an image forming apparatus for forming an image on the sheet; and the aforementioned sheet trimming apparatus for trimming the sheet bundle with an image formed thereon by the image forming apparatus.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

The following describes the present invention with reference to the embodiments of the present invention without the present invention being restricted thereto.

The sheet trimming apparatus of the present embodiment is a constituent of the sheet post-processing apparatus. This sheet post-processing apparatus is connected with an image forming apparatus to constitute an image forming system as a whole.

Figure 2:
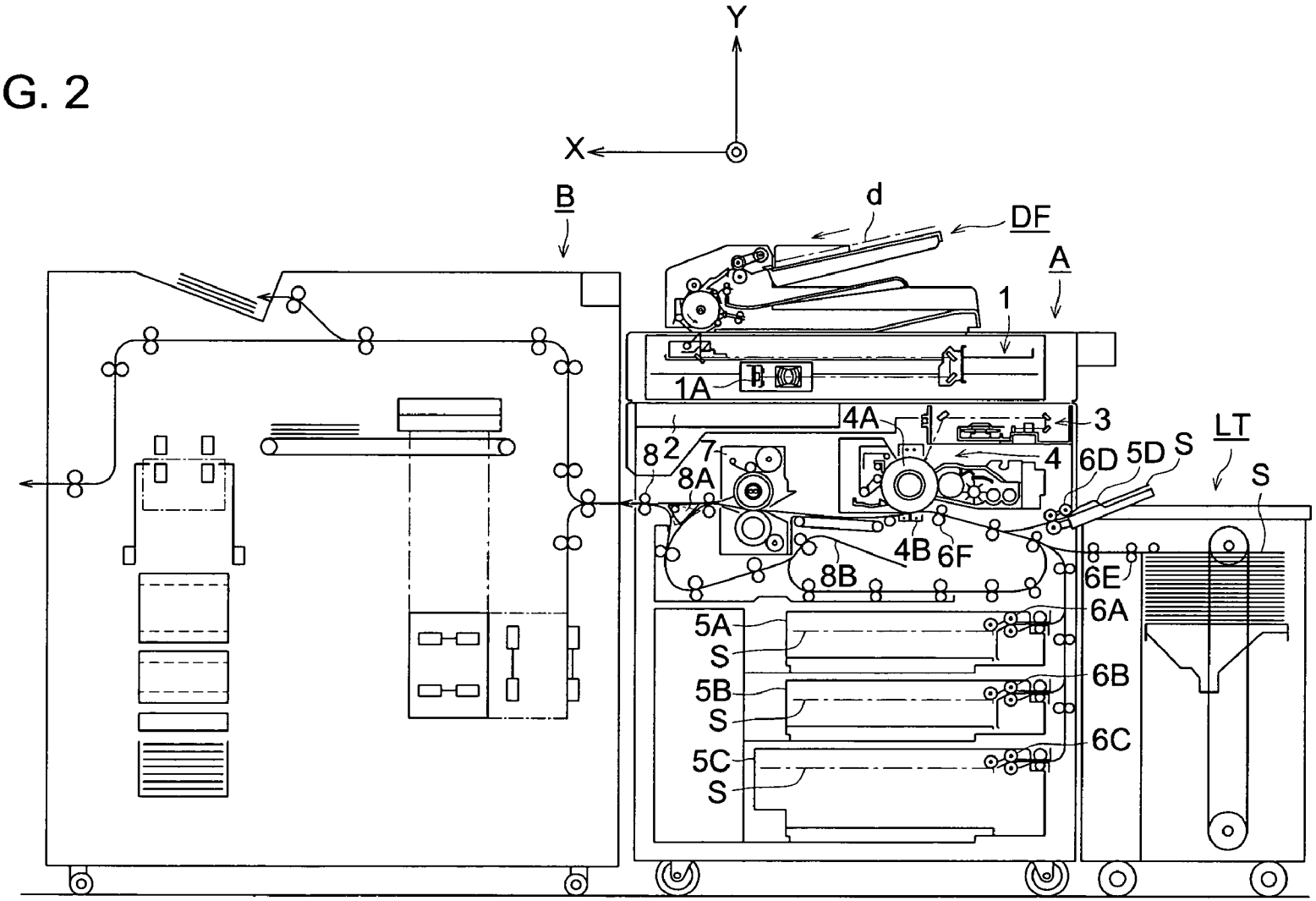
FIG. 2 is an overall schematic diagram showing the image forming system as an embodiment of the present invention.

FIG. 2 is an overall schematic diagram showing the image forming system provided with an image forming apparatus and sheet post-processing apparatus.

Symbol A represents an image forming apparatus, DF an automatic document feeder, LT a high-volume sheet feeding apparatus, and B a sheet post-processing apparatus.

The image forming apparatus A is provided with an image reading section (image input apparatus) 1, image processing section 2, image writing section 3, image forming section 4, sheet feed cassettes 5A, 5B and 5C, manual sheet feed tray 5D, first sheet feed sections 6A, 6B, 6C, 6D and 6E, registration roller 6F, fixing apparatus 7, sheet ejection section 8, automatic duplex copying sheet feed section (ADU), and others.

An automatic document feeder DF is mounted on the upper portion of the image forming apparatus A, and a sheet post-processing apparatus B is connected integrally therewith on the left side of the drawing.

The document d placed on the document platen of the automatic document feeder DF is conveyed in the direction marked by an arrow mark, and the image on one side or both sides of the document is read into the image sensor CCD1A by the optical system of the image reading section 1.

The analog signal subjected to photoelectric conversion by the image sensor CCD1A undergoes analog processing, analog-to-digital conversion, shading correction, image compression and other processing in the image processing section 2, and is then sent to the image writing section 3 as an image information signal.

The image forming section 4 uses electrophotographic process to form an image, and applies the process of charging, exposure, development, transfer, separation and cleaning to the photoreceptor drum 4A. In the aforementioned exposure process, the output light of the semiconductor laser (not illustrated) based on the aforementioned image information signal is irradiated to the photoreceptor drum 4A to form an electrostatic latent image. Further, in the aforementioned development process, the toner image corresponding to the aforementioned electrostatic latent image is formed on the photoreceptor drum 4A.

When the sheet feed cassettes 5A through 5C, manual sheet feed tray 5D, high-volume sheet feeding apparatus LT, and any one of the first sheet feed sections 6A through 6E corresponding thereto have been selected, the sheet S is fed to the registration roller 6F. The sheet S is synchronized with the toner image of the photoreceptor drum 4A by registration roller 6F, and is conveyed to the transfer section 4B, whereby the toner image is transferred.

The sheet S carrying the toner image is fixed by the fixing apparatus 7, and fed from the sheet ejection section 8 into the sheet post-processing apparatus B.

In the duplex image formation mode, the sheet S with an image formed on one side is fed into the automatic duplex copying sheet feed section 8B by the conveyance path switching plate 8A and an image is formed on the opposite side by the image forming section 4. After having been fixed by the fixing apparatus 7, the sheet is fed into the sheet post-processing apparatus B from the ejection section 8.

Figure 3:
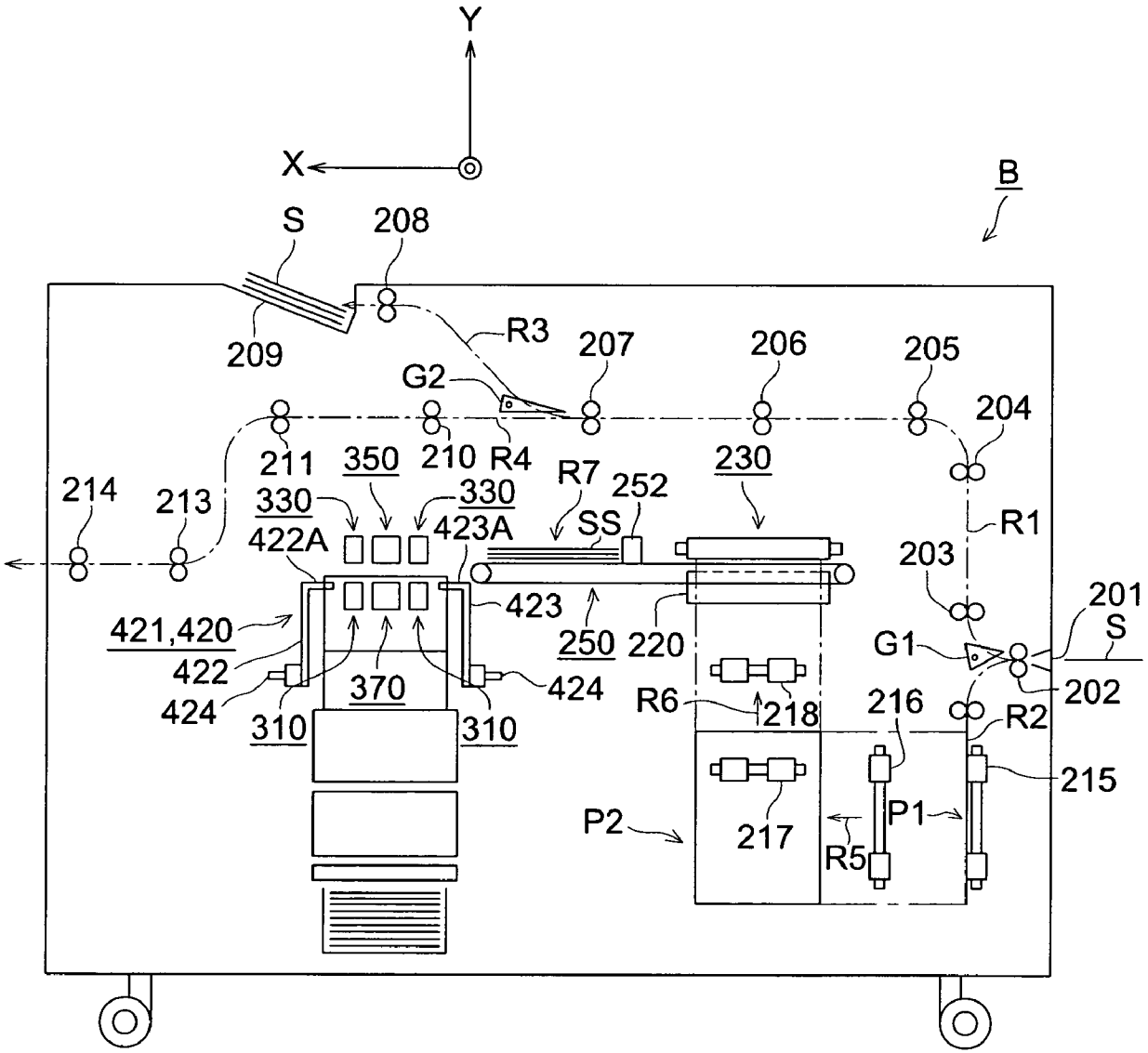
FIG. 3 is a schematic front view representing a sheet post-processing apparatus.
Figure 4:
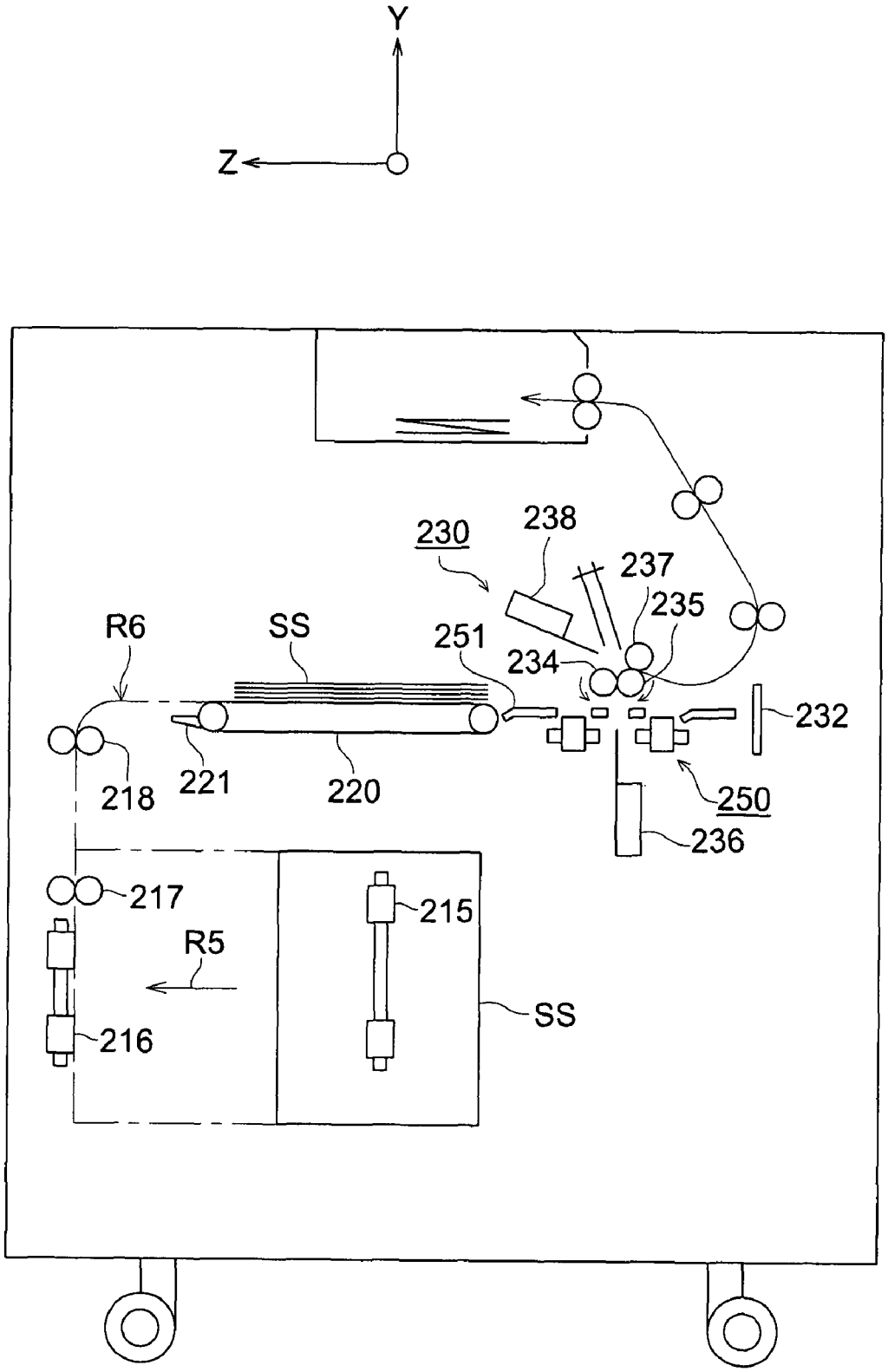
FIG. 4 is a right side view representing a sheet post-processing apparatus of FIG. 3.
Figure 5:
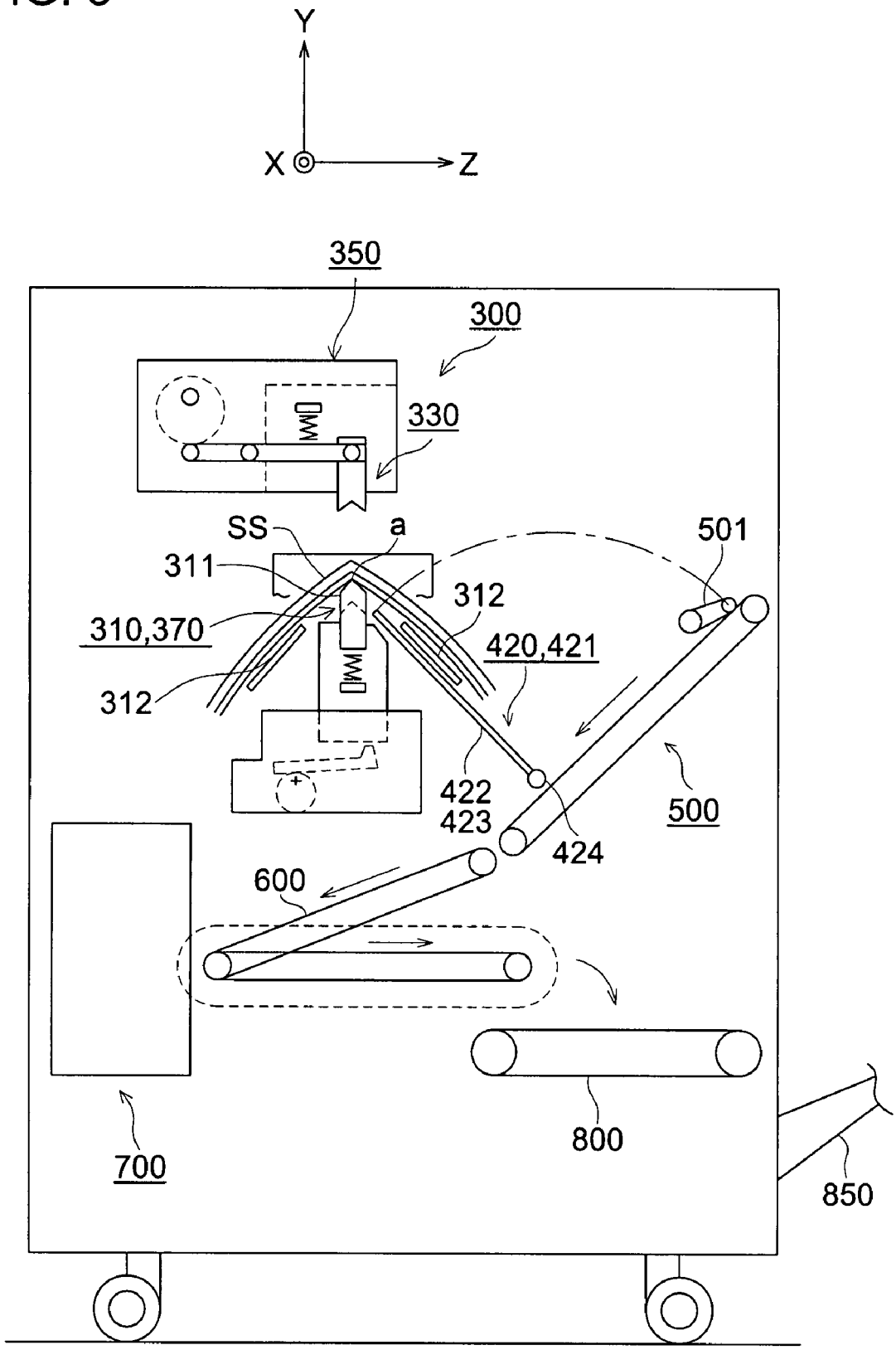
FIG. 5 is a left side view representing a sheet post-processing apparatus of FIG. 3.
Figure 6:
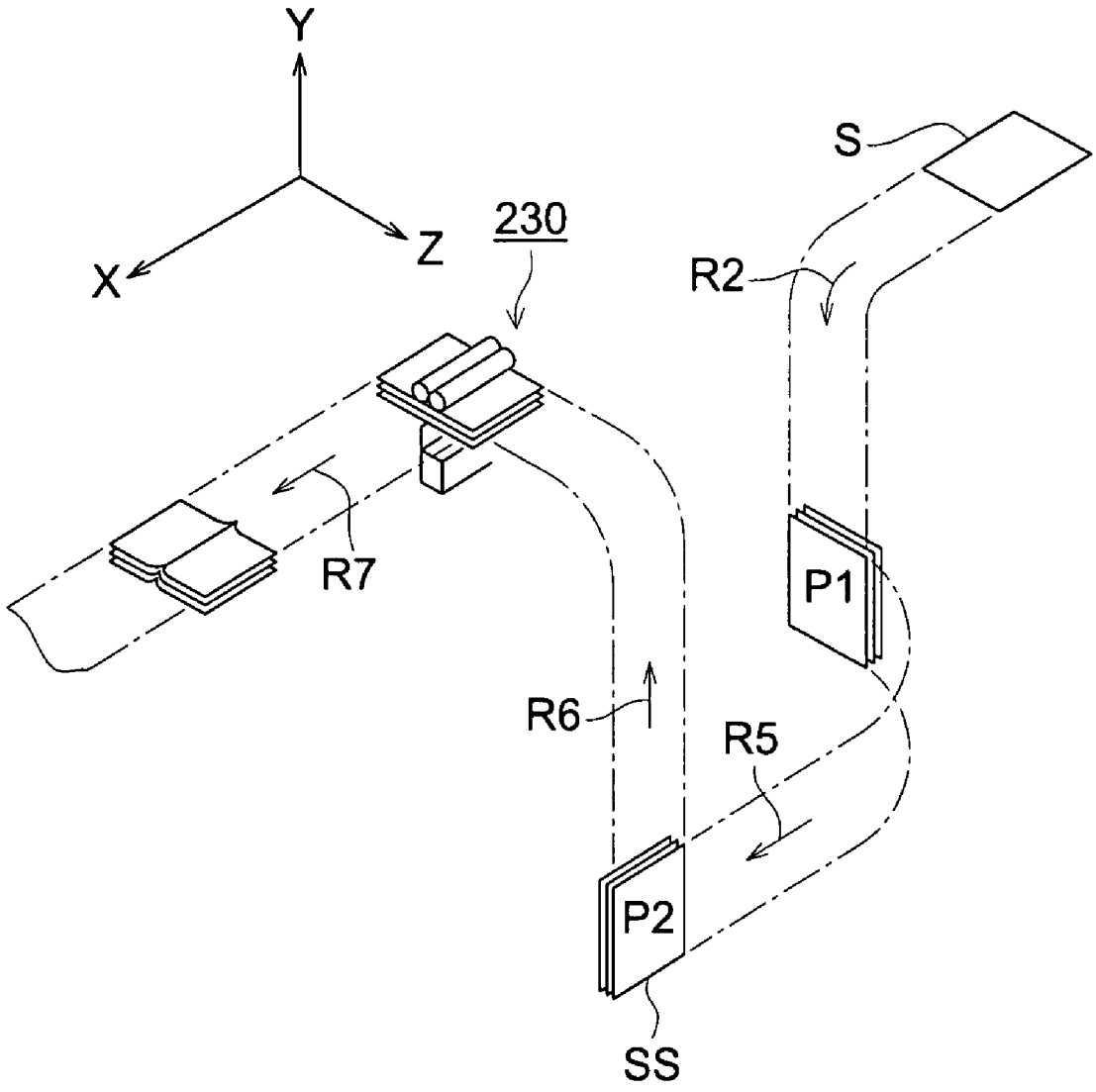
FIG. 6 is a schematic diagram representing part of the sheet flow in the sheet post-processing apparatus.

The following describes the outline of the sheet post-processing apparatus B with reference to FIGS. 3, 4, 5 and 6:

FIG. 3 is a schematic front view representing a sheet post-processing apparatus of the present invention. FIG. 4 is a right side view of the sheet post-processing apparatus. FIG. 5 is a left side view of the sheet post-processing apparatus. FIG. 6 is a schematic diagram representing part of the sheet flow in the sheet post-processing apparatus.

In these drawings, arrow marks X, Y and Z represent the Cartesian coordinates indicating directions. The positive directions of these coordinates are defined as X, Y and Z directions, and the reverse directions are defined as reverse X, Y and Z directions.

"Double circle" is assigned when the arrow mark lies in the direction of the front surface of the paper perpendicular to the paper surface, and "circle" is assigned when the arrow mark lies in the direction of the rear surface.

The sheet S with an image formed thereon by the image forming apparatus is fed to either of the following two paths by the sheet conveyance path switching means at the inlet of the sheet post-processing apparatus B—the sheet conveyance path wherein the sheet is ejected without being processed at all, and the sheet conveyance path wherein the sheet is subjected to center folding and center stitching.

Several stacked sheets S having been fed to the sheet conveyance path wherein the sheet are subjected to center folding and center stitching are subjected to center folding and are stacked on the stacking device arranged in an inverted letter V. When the number of the stacked sheets has reached a predetermined level, the sheets are center-folded and are picked up by a sheet pickup device, and are ejected after the edge as an end of the sheet bundle has been trimmed off by the sheet trimming apparatus of the present invention.

Referring to FIG. 3, the following describes the conveyance path for the sheet S having entered the sheet conveyance path R1.

The sheet S having been fed to the sheet conveyance path R1 by a sheet conveyance path switching means G1 is conveyed sandwiched between the conveyance rollers 203 through 207, and is fed to either the sheet conveyance path R3 over the sheet conveyance path switching means G2 or sheet conveyance path R4 below.

The sheet S having been fed to the upper sheet conveyance path R3 is fed by a sheet ejection roller 208 into the sub-sheet ejection tray (top tray) 209 arranged on the upper portion of the sheet post-processing apparatus B.

The sheet S fed to the lower sheet conveyance path R4 is conveyed sandwiched between the conveyance rollers 210 through 213 and is fed to another sheet post-processing apparatus by the sheet ejection roller 214.

Referring to FIG. 3 and FIG. 6, the following describes the conveyance of the sheet S having entered the sheet conveyance path R2.

The sheet S having entered the sheet conveyance path R2 is fed in the reverse Y direction by the sheet conveyance path switching means G1, and is temporarily stopped and stored at a predetermined position (position P1 in the drawing).

A small number of succeeding sheets S are stacked at the position P1 one on top of another, and are stored therein.

The aforementioned number of sheets to be stored is three in the present embodiment. Without being restricted thereto, the number of sheets to be stored can be set as desired.

Three sheets S stored at position P1 stacked one on top of another are fed in the Z direction by the conveyance rollers 215 and 216, guide plate (not illustrated) and others. Then they are then deflected in the X direction, and are stopped at the position P2 temporarily (sheet conveyance path R5).

In the following description, a plurality of sheets stacked one on top of another are called a sheet bundle SS, unless otherwise specified.

The sheet bundle SS stopped temporarily at position P2 is fed in the Y direction at properly timed intervals by the conveyance rollers 217 and 218, guide plate and others. After that, it is deflected in the reverse Z direction (sheet conveyance path R6).

The sheet bundle SS deflected in the reverse Z direction is fed to the center folding device 230 by the conveyance alignment belt 220.

The following describes the center folding device 230 with reference to FIG. 4.

In the present embodiment, the direction of the long side of the sheet bundle SS is the same as the conveyance direction of the conveyance alignment belt 220.

The center folding device 230 is made up of an alignment member 232, center folding rollers 234 and 235, and a folding knife 236.

The alignment plate 232 is arranged at the position from the point of contact between the center folding rollers 234 and 235 to half the length of the sheet bundle SS along the length.

The sheet bundle SS fed in the reverse Z direction is pushed by the alignment claw 221 located at the conveyance alignment belt 220, and is guided on the guide plate 251 constituting the center folding sheet conveyance section 250 (to be described later). It is stopped where the leading edge of the sheet bundle SS has hit the alignment member 232.

Then the alignment claw 221 is fed forward and backward by the forward and reverse rotation of the conveyance alignment belt 220, and the trailing edge of the sheet bundle SS (three sheets) is pressed to provide width-wise alignment in the conveyance direction.

After the aforementioned aligning operation has terminated, a center folding knife 236 arranged below the point of contact of the center folding rollers 234 and 235 pushes up the center of the sheet bundle SS in the length mounted on the guide plate 251 so that the sheet bundle SS is engaged between the center folding rollers 234 and 235 rotating in the arrow-marked direction as illustrated.

The sheet bundle SS having been engaged is folded at the center along the length by the center folding rollers 234 and 235. After that, the sheet bundle SS is returned onto the guide plate 251 by the rotation of the center folding rollers 234 and 235 in the reverse direction. The sheet bundle SS is then conveyed in the X direction by the center folding sheet conveyance section 250 (to be described later).

When the sheet size has been changed, the position of the alignment plate 232 and the operation of the conveyance alignment belt 220 are changed according to the sheet size by a control section (not illustrated).

Z-shaped folding (folded in three) can be applied to the sheet bundle SS using the roller 237, folding knife 238 and others.

Going back to FIG. 3 and FIG. 6, the sheet bundle SS folded at the center along the length is fed in the X direction is stacked on the stacking device 310 (sheet conveyance path R7) by the conveyance claw 252 provided on the conveyance belt of the center folding sheet conveyance section 250 arranged on, and a guide plate (not illustrated) and others.

Referring to FIG. 5, the following describes the stacking device 310, stapling device 350 and staple receiving device 370 constituting the centering binding section.

The stacking device 310 includes a fold support member 311 shaped like an inverted V and a margin support member 312 also shaped like an inverted V. The fold supporting member 311 supports the portion close to the fold "a" of the valley side surface (lower surface) of the folded sheet bundle SS. The margin support member 312 supports the margin of the valley side surface of the folded sheet bundle SS.

The aforementioned valley side surface of the folded sheet bundle SS is defined as the sheet surfaces opposed to each other internally when the sheet is bent along the fold. The sheet surface on the outside is referred to as a peak side surface.

A vertically movable holding device 330 and a stationary stapling device 350 are arranged over the stacking device 310.

A vertically movable stable receiving device 370 is arranged below the fold "a" of the stacked sheet bundle SS.

A stapling device 350 and staple receiving device 370 as sheet binding devices are arranged at two positions separately with respect to the center, as viewed from the fold of the sheet.

The aforementioned configuration ensures that, when the number of the sheet bundles SS stacked on the stacking device 310 has reached a predetermined level, the holding device 330 lowers to hold the sheet bundle SS. Under this condition, the staple receiving device 370 rises, and staples are driven at two positions on the fold of the sheet bundle SS by the stapling device 350.

Referring to FIG. 3 and FIG. 5, the following describes the procedure of picking up the center-stitched sheet bundle SS.

The pickup device 420 for picking up the sheet bundle SS is made up of a support device 421, drive device (without reference numeral) and others.

The support device 421 contains support members 422 and 423 arranged on both edges of the sheet bundle stacked on the stacking device 310. The support members 422 and 423 are made up of a rod-like member including the bent portions 422A and 423A whose one end is bent at right angles in order to support the fold of the sheet bundle SS.

The other ends of the support members 422 and 423 are supported rotatably about the support shaft 424.

The support members 422 and 423 are arranged removably on the fold of the sheet bundle to support the stacked sheet bundles SS, by the aforementioned drive device, as viewed along the length of FIG. 3.

As shown in FIG. 5, the support members 422 and 423 are made to oscillate about the support shaft 424 by the aforementioned drive device between the position for picking up the sheet bundle SS stacked on the stacking device 310, and the delivery position for receiving the sheet bundle SS and delivering it to the conveyor 500.

The aforementioned configuration ensures that, when the number of the sheet bundles SS stacked on the stacking device 310 has reached a predetermined level and center stitching has been provided by the centering stiching section, the support members 422 and 423 are inserted close to the fold of the stacked sheet to support the fold of the sheet bundle SS. After that, they rotate from the aforementioned receiving position to the aforementioned delivery position and place the sheets on the receiving conveyor 500, whereby the sheet bundles SS placed thereon are supported by a grip 501.

The sheet bundle SS sandwiched by the grip 501 is fed obliquely downward synchronously with the rotation of the receiving conveyor 500, and is released from the grip 501. After that, it is delivered to a trimming conveyor 600.

The trimming conveyor 600 is placed horizontal after the sheet bundle SS has been delivered. With the fold being held by a fold holding member (to be described later), the sheet bundle SS is sent toward a sheet trimming apparatus 700, and is stopped at a predetermined position. Then the misaligned edge (free sheet edge opposite the fold) is trimmed by the sheet trimming apparatus 700 of the present invention so that the edge is aligned.

Upon termination of trimming, the sheet bundle SS is fed in the reverse direction by the trimming conveyor 600, and is dropped from the leading edge of the trimming conveyor 600 in the arrow-marked direction. Then it is collected by the recovery conveyor 800 and is ejected into the sheet ejection tray 850 arranged outside the front surface of the sheet post-processing apparatus B.

Figure 7:
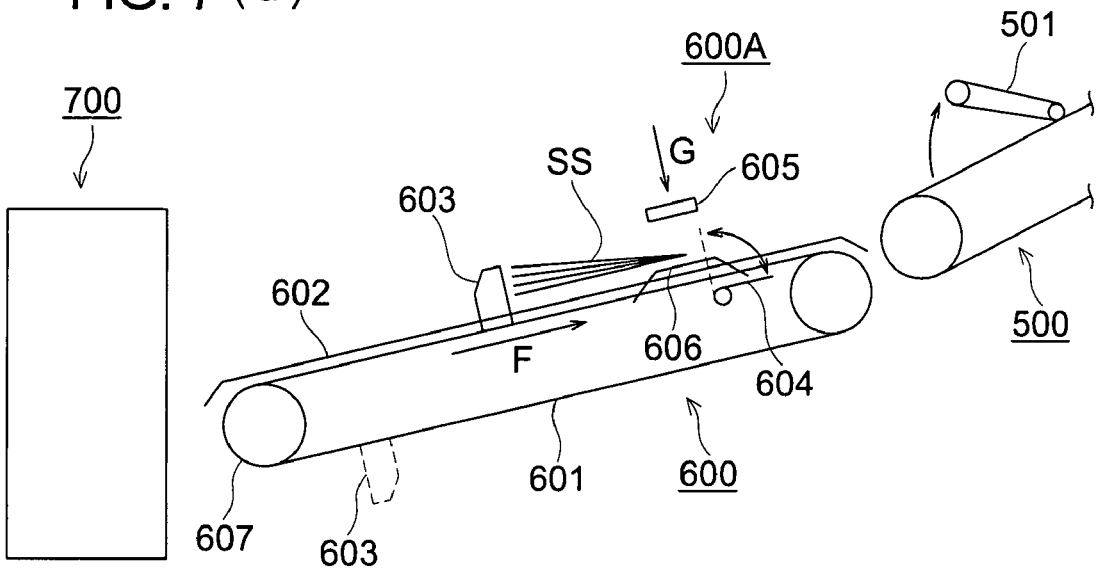
FIGS. 7 (*a*) and (*b*) are schematic diagrams showing a trimming conveyor 600 and a conveyance mechanism for conveying a sheet bundle SS.
Figure 7:
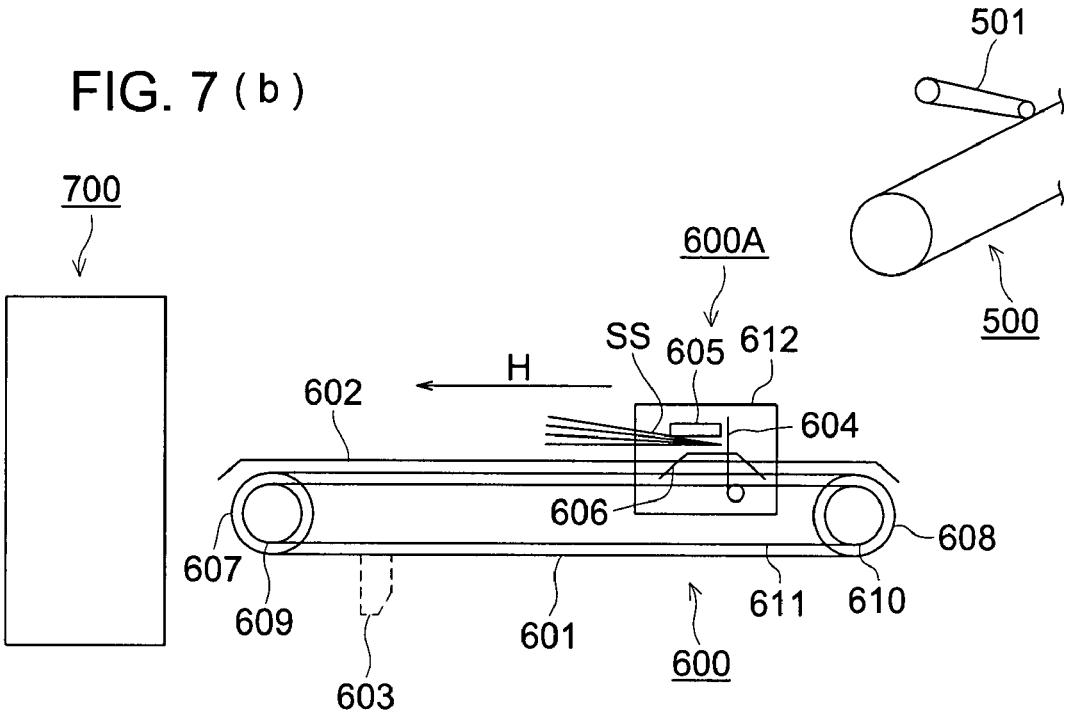
Figure 8:
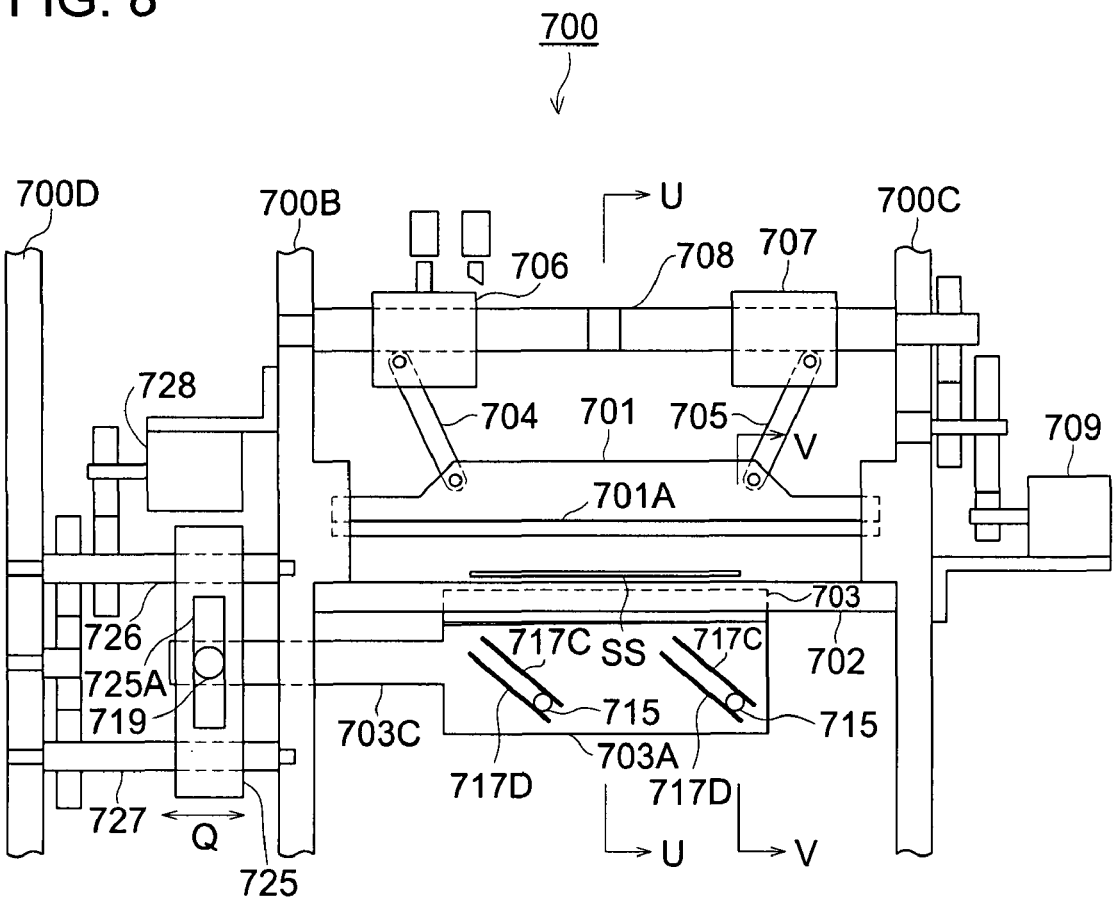
FIG. 8 is a schematic front view as seen from the direction of inserting sheets into the sheet trimming apparatus 700.
Figure 9:
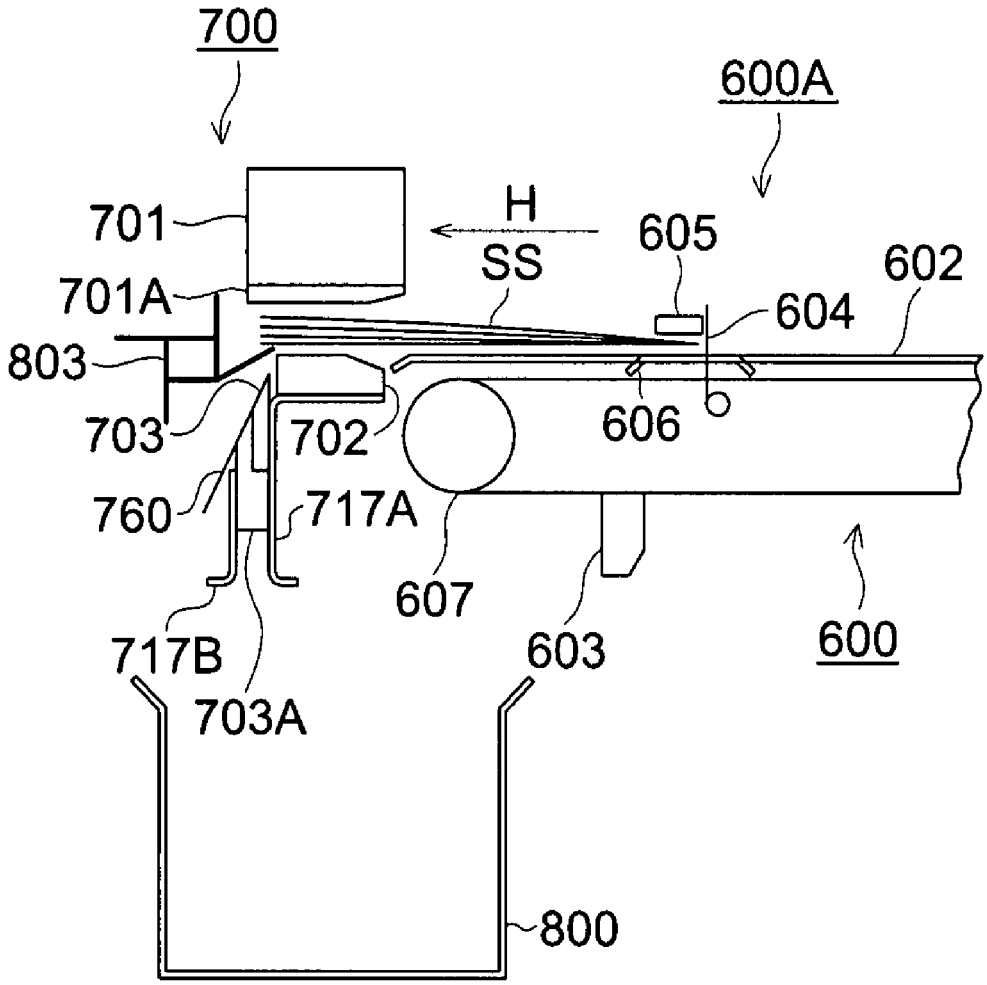
FIG. 9 is a cross sectional view showing the major sections along lines U-U in FIG. 8.

The following describes the details of the sheet trimming apparatus 700 of the present invention with reference to FIG. 7 through FIG. 9.

FIG. 7 are schematic diagrams showing a trimming conveyor 600 and a conveyance mechanism for conveying a sheet bundle SS.

FIG. 8 is a schematic front view of the sheet trimming apparatus 700 as seen from the direction of inserting sheets therein. FIG. 9 is a cross sectional view showing the major sections along lines U-U in FIG. 8.

Referring to FIGS. 7 (*a*) and (*b*), the following describes the mechanism wherein the center-folded and center stitched sheet bundle SS is delivered from the receiving conveyor 500 to the trimming conveyor 600, and is stopped at a predetermined position for edge trimming by the sheet trimming apparatus 700.

As shown in FIG. 7 (*a*), the grip 501 opens close to the terminal point on the downstream side in the sheet conveyance direction of the receiving conveyor 500, whereby the sheet bundle SS having been sandwiched by the grip is released.

The released sheet bundle SS comes close to the belt on the upper side of the conveyance belt 601 applied to the pulleys 607 and 608 stopped in a tilted position, and slides on the slope of the sheet accommodation plate 602 provided in parallel. It comes in contact with the stopper claw 603 fixed to the conveyance belt 601, and is stopped there.

After the sheet bundle SS has stopped, the alignment member 604 rotates from the position indicated by a solid line to the position indicated by a dotted line.

After the alignment member 604 has rotated, the conveyance belt 601 moves in the direction indicated by an arrow mark F, and is stopped by a stopper claw 603 until the fold of the sheet bundle SS is brought into contact with the alignment member 604.

As described above, the sheet bundle SS is brought in contact with the alignment member 604, whereby the skew of the conveyance direction of the sheet is corrected.

After the stopper claw 603 has stopped, the fold holding member 605 lowers in the direction indicated by the arrow G of the drawing, and the sheet bundle SS is sandwiched between the fold holding member 605 and the receiving plate 606 having almost the same plane surface as that of the sheet accommodation plate 602.

After termination of the step of sandwiching of the sheet bundle SS, the trimming conveyor 600 rotates and the stopper claw 603 retracts to the position indicated by the dotted line of the drawing.

When the stopper claw 603 has retracted, the alignment member 604, the fold holding member 605 and receiving plate 606 still sandwiching the sheet bundle SS rotate integrally with the trimming conveyor 600 about the pulley 607 of the trimming conveyor 600, until they reach the horizontal position indicated in FIG. 7 (*b*), where they stop.

After the trimming conveyor 600 has rotated, the sheet bundle SS sandwiched between the fold holding member 605 and receiving plate 606 slides on the sheet accommodation plate 602 to move in the direction H indicated by the arrow, and is inserted into the trimming section of the sheet trimming apparatus 700 by the insertion device 600A. Then the sheet bundle SS is stopped at the position determined by the size of each sheet.

The insertion device 600A includes an insertion belt 611 applied to the pulleys 609 and 610 on the same rotary shaft as that of the pulleys 607 and 608; a moving member 612 holding the alignment member 604, fold holding member 605 and receiving plate 606 fixed on the insertion belt 611; and an insertion motor (not illustrated) for forward/reverse rotation of the insertion belt 611. It rotates about the pulley 607 together with the trimming conveyor 600.

The sheet bundle SS stopped at a predetermined position by the insertion device 600A has its edge trimmed by the sheet trimming apparatus 700. The following describes the details of the sheet trimming apparatus 700 with reference to FIG. 8 and FIG. 9.

The reference numeral 701 is a sheet holding member freely movable in the vertical direction; 701A is cutter blade receiving member mounted integrally on the surface of the sheet holding member 701 opposite the sheet bundle SS; 702 is a sheet receiving member fixed to the main unit lateral surfaces 700B and 700C of the sheet trimming apparatus 700; and 703 is a lower cutter blade as a trimming cutter blade freely movable in the vertical direction.

As illustrated, the cutter blade receiving member 701A is arranged at such a position as to receive the lower cutter blade 703 through the sheet bundle SS.

The reference numerals 704 are 705 indicate connecting rods. As shown in FIG. 8, one end of each rod is mounted close to each of the sheet edges of the sheet holding member 701, and the other end is mounted rotatably on each of the internal thread units 706 and 707.

The internal thread units 706 and 707 are screwed into bail screws 708 having external threads formed in the opposite directions.

The ball screw 708 is rotatably held by the main unit lateral surfaces 700B and 700C of the sheet trimming apparatus 700, and is rotated by a reversible sheet holding motor 709 through a plurality of gears (without reference numeral).

Accordingly, the sheet holding member 701 is moved in the vertical direction by the forward/reverse rotation of the sheet holding motor 709.

A plurality of the aforementioned gears have their speed reduced by the sheet holding motor 709, and the power is transmitted to the ball screw 708.

The aforementioned configuration ensures that a larger torque is produced despite a smaller capacity of sheet holding motor 709, and the sheet bundle SS is sandwiched by a greater force by the cutter blade receiving member 701A and sheet receiving member 702, whereby the misalignment of the sheet at the time of trimming is prevented.

As shown in FIG. 9, the lower cutter blade 703 is fixed to the holding member 703A, and the holding member 703A is slidably guided in the vertical direction by the cutter blade unit guide members 717A and 717B.

The holding member 703A is provided with a rotatable roller 715 arranged at two positions by a predetermined distance away in the lateral direction of FIG. 8. The details will be explained with reference to FIG. 10. The roller 715 is engaged slidably with the guide section formed obliquely from the lower bottom of the cutter blade unit guide members 717A and 717B to the upper left. Similarly, the holding member 703A is provided with a paper scrap guide member 806 (FIGS. 10 and 11) that guides the paper scrap produced at the time of trimming the edge of the sheet bundle SS and drops it below the holding member 703A.

As shown in FIG. 8, the holding member 703A has a connection 703C, and a roller 719 is arranged rotatably on the leading edge of the connection 703C.

The roller 719 is slidably engaged with the guide groove 725A formed in the vertical direction of the lower cutter blade drive member 725.

The lower cutter blade drive member 725 has internally threaded portions engaged with the ball screws 726 and 727. The ball screws 726 and 727 are rotatably held by the main unit side plates 700B and 700D. Further, they are driven through a plurality of gear (without reference numeral) by the reversible lower cutter blade drive motor 728 so that the directions of rotations will be the same with each other.

The forward/reverse rotation of the lower cutter blade drive motor 728 results in the forward/reverse rotation of the ball screws 726 and 727 in the same direction, and the lower cutter blade drive member 725 performs a back-and-forth motion in the direction indicated by the arrow mark Q of FIG. 8. With the back-and-forth motion of the lower cutter blade drive member 725, the roller 715 is guided by the guide section of the cutter blade unit guide members 717A and 717B, and the holding member 703A and lower cutter blade 703 carry out back-and-forth motion from the lower right of FIG. 8 to obliquely upper left.

As will be apparent from the above description, the trimming cutter blade drive device that causes an obliquely vertical movement of the trimming cutter blade 703 is made up of a lower cutter blade drive motor 728, ball screws 726 and 727, and lower cutter blade drive member 725.

Mainly referring to FIG. 9, the following describes the operation of the sheet trimming apparatus 700 having the aforementioned configuration, insertion operation of the sheet bundle SS into the trimming section, and pickup operation.

Being sandwiched between the fold holding member 605 and receiving plate 606, the sheet bundle SS having been center-folded and center-stitched slides on the sheet accommodation plate 602 to move in the direction marked by arrow mark H in FIG. 9. Then the sheet bundle SS is inserted into the trimming section made up of a cutter blade receiving member 701A, sheet receiving member 702 and lower cutter blade 703, and is stopped at the position determined by each sheet size.

When the sheet bundle SS has stopped, the sheet holding motor 709 (FIG. 8) rotates and the sheet holding member 701 lowers. The portion close to the trimming edge of the sheet bundle SS is sandwiched between the cutter blade receiving member 701A and sheet receiving member 702.

When the sheet bundle SS is sandwiched, the lower cutter blade drive motor 728 (FIG. 8) rotates. The lower cutter blade 703 presses and cuts the sheet bundle SS until the leading edge thereof slightly cuts into the cutter blade receiving member 701A, and goes obliquely to the upper left in FIG. 8, whereby edge trimming of the sheet bundle SS is performed.

Upon termination of the edge trimming, the lower cutter blade drive motor 728 performs a reverse rotation and the lower cutter blade 703 goes down to a predetermined position obliquely to the lower right of FIG. 8.

When the lower cutter blade 703 has lowered, the sheet holding member 701 rises to a predetermined position.

When the sheet holding member 701 has risen, the fold holding member 605 and receiving plate 606 sandwiching the portion close to the sheet bundle SS goes back to the position indicated in FIG. 7 (*b*). Then the fold holding member 605 rises and the alignment member 604 retracts to the lower position from the sheet conveyance surface, whereby the sheet bundle SS is released.

Then the trimming conveyor 600 rotates, and the sheet bundle SS whose edge has been trimmed by the stopper claw 603 drops in the arrow-marked direction from the leading edge of the trimming conveyor 600, as shown in FIG. 5. The sheet bundle SS is conveyed by the rotating recovery conveyor 800, and is ejected into the sheet ejection tray 850 arranged outside on the front of the sheet post-processing apparatus B.

Figure 10:
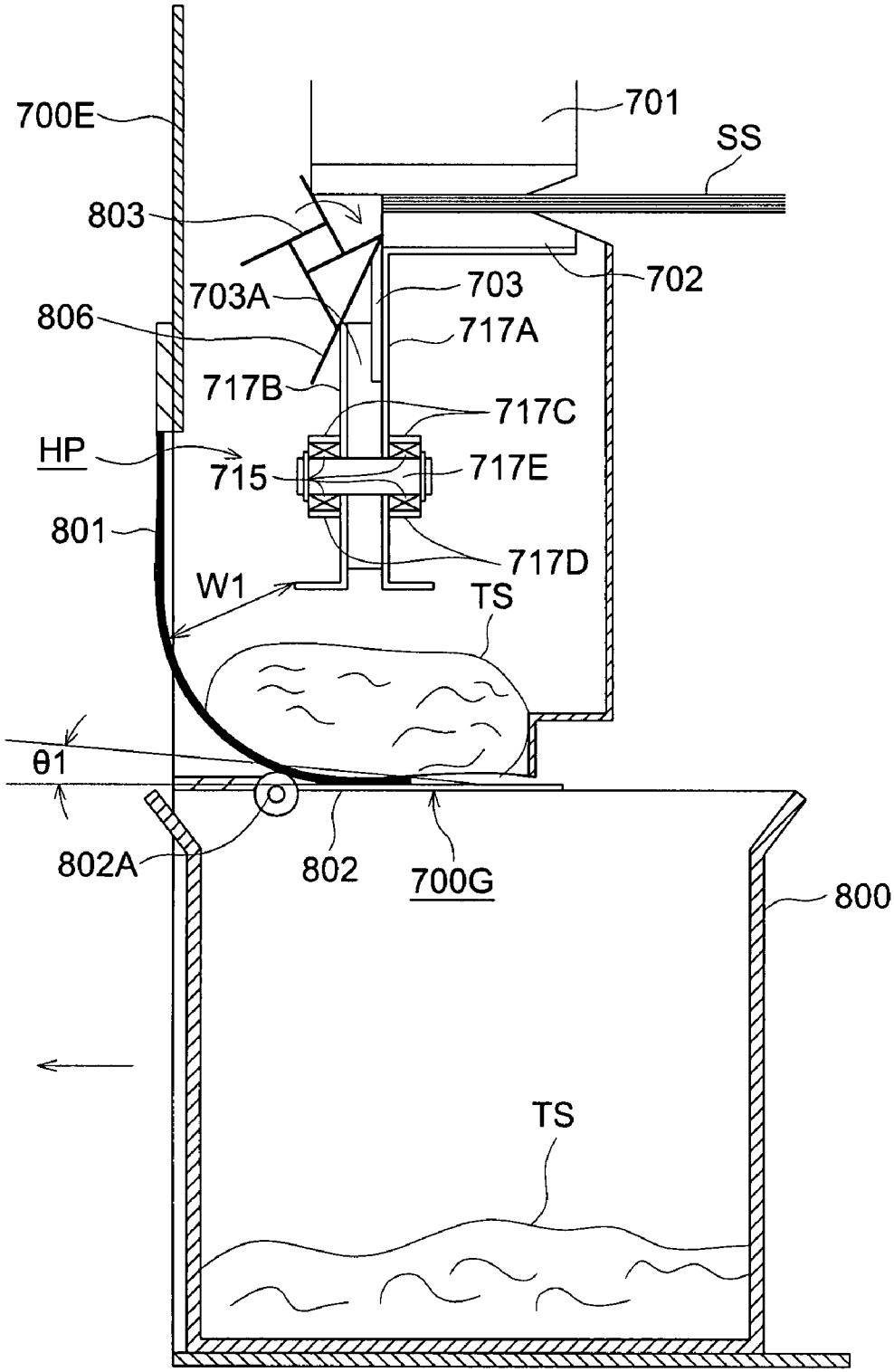
FIG. 10 is a cross sectional view showing the major sections along lines V-V in FIG. 8 (temporary paper scrap stacking phase)
Figure 11:
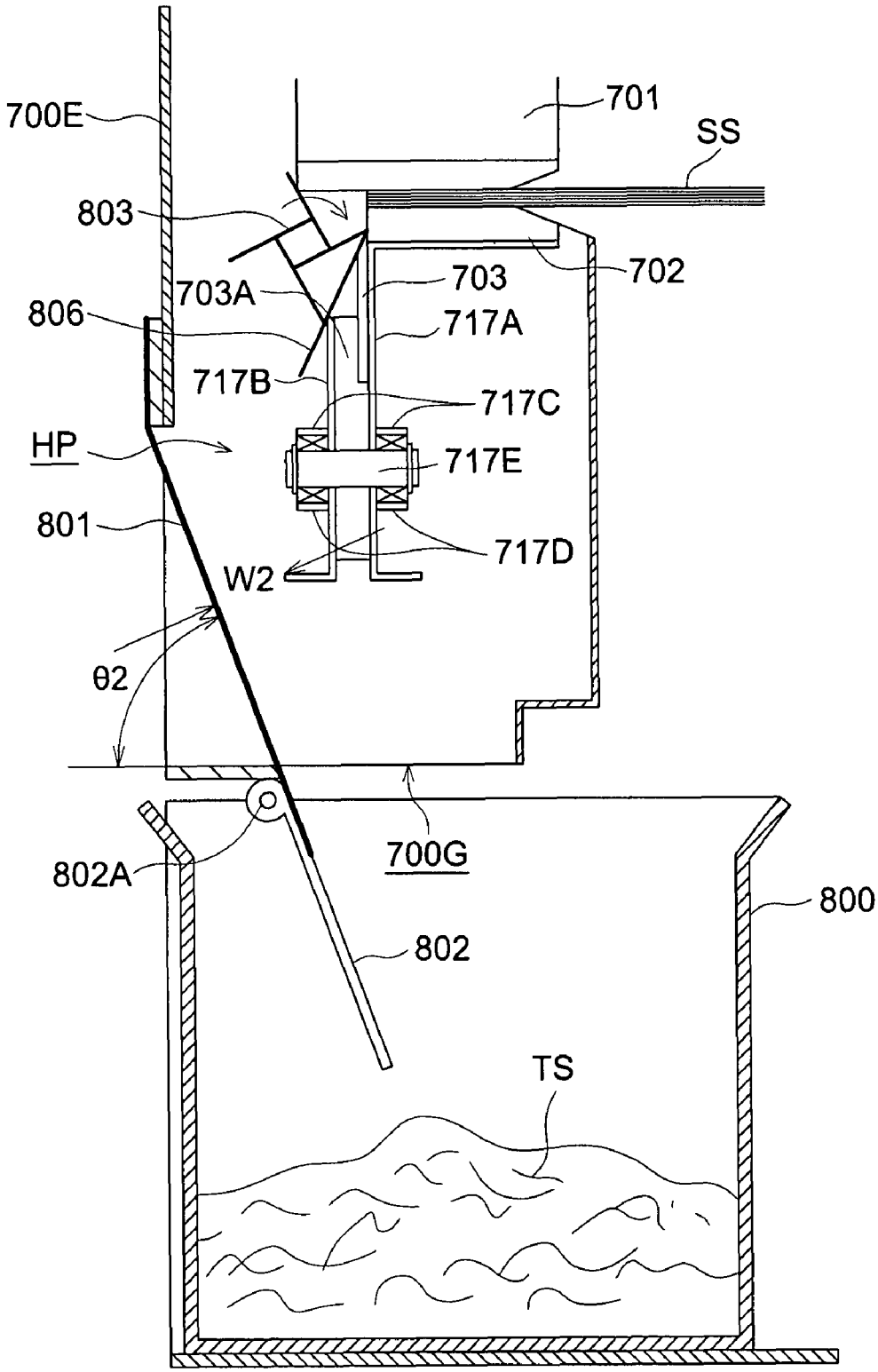
FIG. 11 is a cross sectional view showing the major sections along lines V-V in FIG. 8 (the phase of stacking the paper scrap into paper scrap container)
Figure 12:
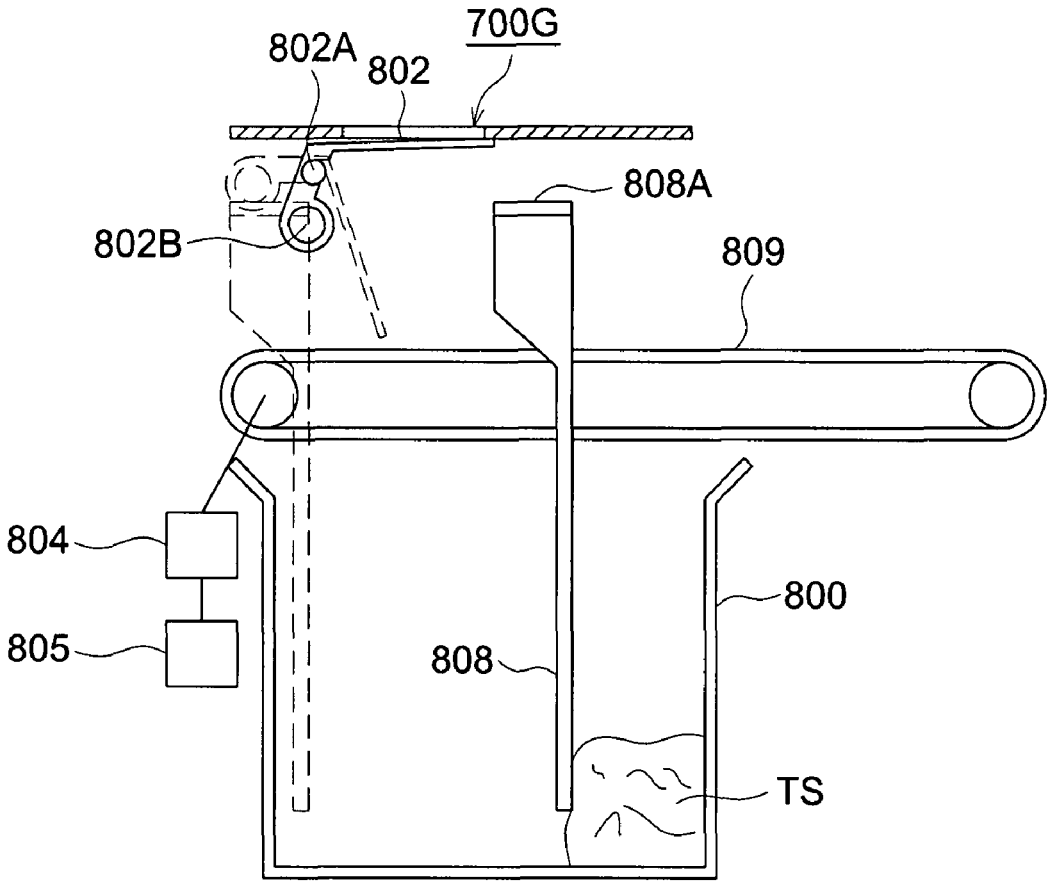
FIG. 12 is a diagram showing the drive mechanism of the shutter 802.

The following describes the paper scrap stacking section with reference to FIG. 8, and FIG. 10 through FIG. 12. FIG. 10 is a front cross sectional view showing the stacking section in the phase of temporarily stacking the paper scrap TS before final stacking in the paper scrap container 800. FIG. 11 is a front cross sectional view showing the stacking section in the phase of stacking the paper scrap TS in the paper scrap container 800. FIG. 12 is a diagram showing the drive mechanism of the shutter 802 temporarily stacking the paper scrap TS.

The lower cutter blade 703 is removably secured on the holding member 703A, and the holding member 703A is slidably guided by the plate-formed cutter blade unit guide members 717A and 717B arranged in the vertical direction, as described above.

The reference numeral 717E denotes the roller mounting shaft secured on the holding member 703A, and a roller 715 is rotatably mounted on each end of the roller mounting shaft 717E. The roller 715 is slidably held between a pair of ridges 717C and 717D as the drive cams rising vertically from the side surface of the cutter blade unit guide members 717A and 717B.

As described above, the ridges 717C and 717D are inclined from the lower right obliquely to the upper right, as shown in FIG. 8.

As described above, the holding member 703A moves to the left in FIG. 8 to be drive upward, and the trimming cutter blade 703 rises so that the sheet bundle SS is trimmed. The paper scrap TS separated from the sheet bundle by trimming is stacked in the paper scrap container 800 arranged below the trimming section. The stacking mechanism is shown in FIGS. 10 and 11.

The sheet trimming section is bonded with the guide member 806 made up of a flexible member such as a PET (polyethylene terephthalate) film in an inclined form, as illustrated. The paper scrap TS is guided by the guide member 806, to fall to the lower left on the guide member 806. A guide place 801 and shutter 802 made up of PET are arranged below the sheet trimming section. It should be noted that the guide pieces 801 and 806 are preferably made of conductive PET to avoid electrostatic charging.

The reference numeral 803 denotes a paper scrap removing member to which an elastic blade made of four polyurethane rubbers is fixed, whereby the paper scrap is removed from the trimming section by rotation.

The reference numeral 802 is a shutter, which rotates about the shaft 802A to the close state in FIG. 10 and to the open state in FIG. 11 so that the opening 700G will be opened and closed. On the side opposite the shutter 802 with respect to the shaft 802A, a weight member 802B (to be described later) is formed integrally with the shutter 802. Energy is provided by the weight member 802B (FIG. 12, to be described later) in such a way that the shutter 802 will rotate in the counterclockwise direction.

The reference numeral 801 is a guide piece as a paper scrap guide member for guiding the paper scrap TS downward. The lower end thereof is bonded to the shutter 802. When the shutter 802 rotates, the guide piece bends, as shown in FIG. 10, to form two states; a state of creating a space for stacking the paper scrap TS and a tabular state of allowing the paper scrap TS to drop downward, as shown in FIG. 11.

Figure 1:
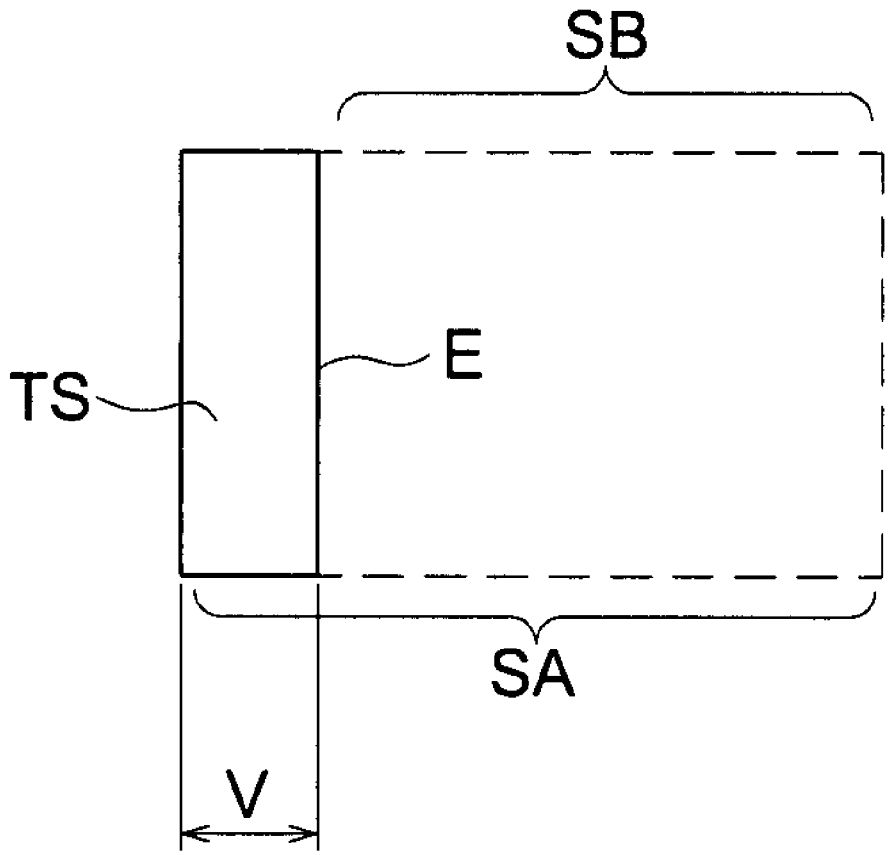
FIG. 1 is a drawing showing a paper scrap.

In the falling space HP wherein the paper scrap TS falls from the trimming section to the paper scrap container 800, the narrowest gap is between the guide piece 801 and the lower end of the cutter blade unit guide member 717B is the narrowest. As shown in FIG. 1, the paper scrap TS is made up of a belt-shaped piece of paper having a sheet width V. The sheet width V varies according to the size of the recording sheet to be used, and the size of the booklet to be formed.

In a compactly designed sheet trimming apparatus, there is a restriction to the aforementioned gap in the falling space HP, and therefore, the paper scrap TS may be jammed in the falling space HP. In the present invention, to prevent such jamming of the paper scrap TS, the aforementioned gap is made variable, as will be explained below. Further, the wall of the falling space is formed, and the angle of the paper scrap guide member for guiding the fall of the paper scrap TS is made variable.

In the temporary stacking of the paper scrap TS shown in FIG. 10, the guide piece 801 is secured on the shutter 802 in the bottom portion, and therefore, the tilt angle θ1 for rising from the bottom portion is set at about 0 through 20 degrees. In the meantime, the top end of the guide piece 801 is secured on the frame in the vertical direction, and therefore, the lower portion of the guide piece 801 is bent, as shown in FIG. 10, thereby increasing the gap W1 between the guide piece 801 forming the wall of the falling space and the cutter blade unit guide member 717B.

Accordingly, even the paper scrap TS having a greater sheet width falls in the falling space HP without being jammed, and is stacked on the lower portion of the guide piece 801 and the shutter 802.

In FIG. 11, the shutter 802 rotates temporarily stacked paper scrap TS falls into the paper scrap container 800. In this case, the guide piece 801 assumes the form of a flat plate wherein an almost straight line is formed by the cross section, as shown in FIG. 11.

In the state of FIG. 11, the tilt angle θ2 on the lower portion of the guide piece 801 is set at about 60 through 70 degrees, a value greater than θ1. This tilt angle θ2 ensures that the temporarily stacked paper scrap TS falls into the paper scrap container 800 without being jammed.

The gap W of the falling space HP refers to the shortest distance between the guide piece 801 and the wall forming the falling space opposite thereto. The tilt angle θ of the surface formed by the guide piece 801 is the angle formed between the guide piece 801 and the horizontal line on the surface on which the paper scrap TS is stacked, namely, the upper surface of the shutter 802.

As described above, when the paper scrap TS is stacked on the guide piece 801 and shutter 802, the gap W of the falling space HP is increased by the deformation of the guide piece 801 so that the paper scrap TS is not jammed in the falling space HP. Further, when the temporarily stacked paper scrap TS falls into the paper scrap container 800, the tilt angle θ of the guide piece 801 is increased, whereby the paper scrap TS falls smoothly to be accommodated in the paper scrap container 800.

The paper scrap container 800 is installed below the opening 700G. The paper scrap container 800 moves in the direction perpendicular to the paper surface and is mounted on the sheet trimming apparatus 700, from which the paper scrap container 800 is taken out.

The shutter 802 is driven by the drive mechanism shown in FIG. 12.

The shutter 802 rotates to release the opening 700G as shown in FIG. 11. The paper scrap TS having fallen by the release of the opening 700G is accommodated in the paper scrap container 800.

The paper scrap compression member 808 is arranged to expand inside the paper scrap container 800. The paper scrap compression member 808 is made up of a plate-formed member mounted on the belt 809 or a frame-like member containing several rods. It is moved from the dotted line on the left to the solid line on the right by the movement of the belt 809, thereby compressing the paper scrap TS inside the paper scrap container 800. The paper scrap compression member 808 is made to retract from inside the paper scrap container 800 by the release of the door (not illustrated) so that the paper scrap container 800 can be taken out.

The motor 804 is started or stopped under the control of the control section 805. The belt 809 is driven by the motor 804, and the paper scrap compression member 808 is moved to the right from the position of dotted line. The weight member 802B mounted on the head section 808A of the paper scrap compression member 808 rotates in the counterclockwise direction when the head section 808A has retracted toward the right. The shutter 802 rotates integrally with the weight member 802B to close the opening 700G. In this manner, the paper scrap TS having fallen in the paper scrap container 800 is moved to the right and is compressed. At the same time, the opening 700G is closed to reach the state shown in FIG. 10, and the paper scrap TS is stacked temporarily on the guide piece 801 and shutter 802.

When the sheets in the predetermined number, e.g., 100 sheets are trimmed, the motor 804 rotates in the opposite direction, so that the paper scrap compression member 808 is moved from the solid line (FIG. 12) to the dotted line. This movement allows the head section 808A to push the weight member 802B, and the shutter 802 is rotated in the clockwise direction so that the opening 700G is released, whereby the paper scrap TS falls into the paper scrap container 800.

The paper scrap TS is stacked according to the operation procedure described below:

Paper scraps TS separated from the sheet bundle SS by trimming fall on the guide member 806, and are removed by the rotating paper scrap removing member 803. They fall down to be stacked on the guide piece 801 and shutter 802.

In the trimming process wherein a predetermined number of sheets are trimmed, paper scraps are stacked in the state shown in FIG. 10. When more than a predetermined number of sheets are to be trimmed, the control section 805 starts the motor 804 so that the paper scrap compression member 808 at the position indicated by the dotted line is moved to the left in FIG. 12. This arrangement allows the shutter 802 to rotate in the clockwise direction, thereby releasing the opening 700G.

This operation causes falling of the paper scraps TS stacked on the guide piece 801 and shutter 802. In this case, the guide piece 801 is vibrated by the drive of the shutter 802 so that paper scraps TS being jammed in the falling space fall down.

Then the motor 804 rotates in the opposite direction to cause the paper scrap compression member 808 to move to the right, whereby the paper scrap TS is compressed. This movement of the paper scrap compression member 808 is accompanied by the rotation of the shutter 802 in the counterclockwise direction so that the opening 700G is closed.

It should be noted that the rotation of the shutter 802 and movement of the paper scrap compression member 808 can be repeated several times.

When a sheet trimming apparatus is designed in a compact configuration so that a restriction is imposed on the size of the gap in the space wherein paper scraps falls, the present invention ensures paper scraps to be accommodated in a paper scrap container without being jammed in the falling space.

What is claimed is:

1. A sheet trimming apparatus comprising:

a trimming section provided with a trimming cutter blade for trimming a sheet bundle;

a paper scrap container for storing paper scraps separated from the sheet bundle by the trimming cutter blade; and a paper scrap guide member made of a flexible member, which is provided to create, under the trimming section, a falling space through which the paper scraps are made to fall from the trimming section to the paper scrap container, wherein the falling space is formed between the paper scrap guide member and a wall member opposed to the paper scrap guide member;

a shutter temporarily stacking the paper scraps on the shutter above the paper scrap container when the shutter is closed and dropping the temporarily stacked paper scraps into the paper scrap container when the shutter is opened, and on a surface of the shutter the paper scrap guide member being connected;

wherein when the shutter is closed the paper scrap guide member is pushed by the shutter to assume a first state of being bent for significantly expanding a gap of the falling space between the paper scrap guide member and the wall member, and when the shutter is opened the paper scrap guide member is pulled by the shutter to assume a second state of narrowing the gap and creating an inclined flat surface for guiding the paper scraps to fall.

2. The sheet trimming apparatus of claim 1, further comprising a paper scrap removing member for removing the paper scraps from the trimming section.

3. The sheet trimming apparatus of claim 1, wherein further comprising a paper scrap compression member for compressing the paper scraps in the paper scrap container.

* * * * *